United States Patent [19]

Permut et al.

[11] 4,153,881

[45] May 8, 1979

[54] EARLY FLOOD WARNING SYSTEM

[76] Inventors: Alan R. Permut; Albert A. Permut; Ronald M. Permut, all of 6995 Sweetwater Ct., Boulder, Colo. 80301

[21] Appl. No.: 900,906

[22] Filed: Apr. 28, 1978

Related U.S. Application Data

[63] Continuation-in-part of Ser. No. 846,679, Oct. 31, 1977.

[51] Int. Cl.[2] ..... G08B 25/00

[52] U.S. Cl. ..... 325/64; 325/466; 340/539; 340/620; 73/304 R

[58] Field of Search ..... 340/539, 601, 612, 616, 340/619, 620, 201 R; 73/171, 290, 304; 235/92 FL; 325/51, 54, 64, 466

[56] References Cited

U.S. PATENT DOCUMENTS

| | | | |
|---|---|---|---|
| 3,947,692 | 3/1976 | Payne | 340/618 |
| 3,983,549 | 9/1976 | Akita et al. | 340/618 |
| 4,058,765 | 11/1977 | Richardson et al. | 340/620 |
| 4,083,657 | 4/1978 | Misener | 73/304 R |

*Primary Examiner*—Robert L. Griffin
*Assistant Examiner*—Edward L. Coles

[57] ABSTRACT

An Early Flood Warning System provides advanced warning of probable flash floods and/or stage floods to potential flood victims by collecting and analyzing rainfall and stream level data, and by providing means for disseminating alarms and instructions to individuals in threatened areas. Said Early Flood Warning System contains: a plurality of automated electronic digital liquid level gauges, some of which are specially adapted as rain gauges, and some of which are specially adapted as stream level gauges; a plurality of gauge actuated transmitters; a receiver; a decoder and validity logic unit; a data analysis unit; a central disaster alert station; and a plurality of disaster alert modules. Said digital liquid level gauges are energy and environmental intensive devices which electronically measure, using digital techniques, liquid levels such as rainfall and stream level, and transmit data by coded radio frequency (R.F.) signals to a central data analysis facility. Said digital liquid level gauges are remotely located and independent of each other.

24 Claims, 4 Drawing Figures

EARLY FLOOD WARNING SYSTEM

ORIGIN OF INVENTION

The invention described herein is a continuation-in-part of pending application Ser. No. 846,679 filed Oct. 31, 1977, and presents additional utility of existing functions described in subject application, as well as presenting new matter which is a logical outgrowth of subject application.

BACKGROUND OF THE INVENTION

1. Field of the Invention

The present invention generally relates to liquid level gauges and, more particularly to early flood detection and warning systems which are used to determine threat of flash flood or stage flood, and provide sufficient early warning to potential victims in the affected area.

2. Description of the Prior Art

An early flood warning system requires a highly reliable liquid level measuring device for measuring rainfall and/or stream level. Existing liquid level measuring devices employ float switches, mechanical tipping mechanisms, some type of mechanical to electrical transduction, or measurement of a variable liquid characteristic such as resistance, capacitance, or inductance to determine the level of the liquid being measured. Any type of mechanical mechanism may be damaged or otherwise rendered inaccurate by environmental factors, foreign objects or debris carried in the liquid, vibration, or accidental device mishandling. Measurement of an electrical variable such as resistance, capacitance or inductance is subject to variation due to temperature, and changes in the composition of the liquid being measured. Existing early flood warning systems utilize rain and stream level gauges which suffer these and other significant disadvantages.

Rain gauges most commonly in use are either manual types, which require constant monitoring by personnel, or automated tipping bucket types. The latter of these depends on a very delicate reciprocating balance to determine the amount of rainfall by weight. The tipping action activates switches, which record the events on a strip chart or similar recording device. The delicate nature of this mechanical mechanism makes it extremely susceptible to damage and/or inaccuracy do to vibration, deposited debris, and/or vandalism. Furthermore, permanent data loss can occur if recording of, or transmission of the tipping action is interrupted, since one such event is indistinguishable from another.

Stream level gauges which sound alarms or the like, when the water level reaches a predetermined critical level, do not provide necessary advanced warning for areas near the gauge site, nor does the gauge provide information from which stream level rise rate can be accurately calculated. Malfunction of the single level detector (usually a float switch) can result in failure of the entire warning system. Existing multilevel stream gauges which use float switches as level detectors, can be damaged by debris carried in the stream water, causing malfunction of the gauge. In order to protect delicate float mechanisms from such damage and to achieve reliable recording of stream level, costly stilling basin installations are required. Existing rain and stream level gauges do not distinguish between short term level transient conditions caused by vibration, splashing or wave motion, and a longer term genuine level change.

Electronic gauges which rely on analog circuits to accomplish level measurement are highly susceptible to inaccuracy due to power supply and temperature variations.

Previously proposed flood warning systems which automatically collect rainfall and stream level data do so by using polling or interrogating schemes, whereby at predetermined intervals a signal from a central facility is conveyed to each of the gauges in a network, interrogating the current gauge status. Such systems are unnecessarily costly since they require two-way communication networks. In order to achieve adequate and reliable data collection these systems must interrogate the gauges frequently regardless of the prevailing meteorological conditions. Such frequent interrogations and gauge responses introduce undesirable and unnecessary radiant energy into the environment, and needlessly consume valuable energy. Remotely located gauges must also be connected to power lines, or contain very large energy storage facilities in order to sustain frequent data transmission demands of such a system. An additional disadvantage of such polling schemes is that large quantities of redundant data are collected during extended periods of little or no adverse meteorological activity.

Furthermore, existing systems do not integrate the functions of rainfall and stream level monitoring with effective warning systems so that with existing systems critically valuable time is lost between data collection and flood prediction and subsequent warning to potential victims.

A need therefor exists for a new Early Flood Warning System which does not suffer the above disadvantages and limitations, and which contains: a network of automated digital liquid level gauges specially adapted to operate as rain and stream level gauges; data analysis facilities; and disaster alert devices.

OBJECTS AND SUMMARY OF THE INVENTION

It is the primary object of the present invention to provide a new Early Flood Warning System which reliably and cost effectively collects rainfall and stream level data from a network of remotely located and independent digital liquid level gauges, calculates critical parameters related to flash flood and/or stage flood prediction, and which provides means by which flood warnings may be rapidly disseminated.

It is also an object of the present invention to provide a digital liquid level gauge which may be specially adapted to serve as an automated rain gauge or an automated stream level gauge.

Another object of the present invention is to provide a digital liquid level gauge which uses highly reliable electronic level detection means, which operates in the digital domain, and is cost effective.

Still another object of the present invention is to provide a digital liquid level gauge which does not use any moving parts for level detection.

Another object of the present invention is to provide a digital liquid level gauge which does not utilize changes in electrical resistance, capacitance, or inductance of the liquid as a measuring technique, and which is not sensitive to changes in these and other liquid characteristics.

Yet another object of the present invention is to provide a digital liquid level gauge which operates with minimal energy consumption, is immune to general AC or utility power failure, and causes minimal impact on the environment by restricting the amount and time of radiant energy transmission.

A further object of the present invention is to provide a digital liquid level gauge which transmits coded signals containing gauge identification and current level information only when the liquid level changes by one increment as determined by sensing electrode separation.

Still another object of the present invention is to provide a digital liquid level gauge which only reports bonified level changes, thus ignoring short term changes due to splashing, vibration, or wave motion.

Another object of the present invention is to provide a digital liquid level gauge which does not suffer permanent data loss due to temporary interruption of data transmission or data reception, by virtue of true data recovery on subsequent transmissions.

A further object of the present invention is to provide a data decoder and validity logic unit which requires that received coded R.F. signals are of a prescribed format and are repeated a selected number of times before the so received signals are established as valid data.

Yet another object of the present invention is to provide an Early Flood Warning System which utilizes and provides additional utility and cooperation with the Disaster Alert System described in the subject application of which this application is a continuation in part.

These and other objects of the present invention are achieved by providing an Early Flood Warning System comprised of; digital liquid level gauges specially adapted to serve as rain and stream level gauges, gauge actuated transmitters, a receiver, a decoder and validity logic unit, a data analysis unit, a central disaster alert station, and a plurality of disaster alert modules.

More specifically, the digital liquid level gauge contains a set of sensing electrodes mounted in a spaced relation to each other, and a means for applying a voltage to the level sensing electrodes via any liquid which is somewhat electrically conductive. Digital electronic elements detect which level sensing electrodes are in contact with the liquid, and which is the highest of those electrodes in contact with the liquid. Additional circuitry requires that changes in the liquid level persist for a predetermined time period before the level sensing circuits recognize the changes in level as bonified level changes. This feature eliminates data collection of transient level change due to splashing of the liquid, wave motion or vibratory effects. The level sensing circuits generate a discrete digital output which represents the level of the liquid being measured. The circuitry also activates output displays and/or a transmitter whenever a bonified level change occurs. The transmitter transmits coded R.F. signals representing the bonified level of the liquid being measured.

In those liquid level gauges specially adapted as automated rain gauges, a collecting vessel and level sensing column are provided for collecting and accumulating rainfall. The level sensing electrodes are located in the level sensing column. The level sensing circuits also detect when the accumulated rain reaches the uppermost level sensing electrode and activates an emptying valve, very rapidly draining the accumulated rainfall from the level sensing column so as to minimize total accumulative error over extended time periods.

Those digital liquid level gauges specially adapted as stream level gauges require only that the array of level sensing electrodes and the means for applying a voltage are mounted generally perpindicular to and exposed to the rising and falling level of water in the stream.

The transmitted coded R.F. signals are received by a receiver, which provides a modified version of the received signals to decoder and validity logic circuits. These circuits decode the received signals, extracting gauge identity and level data from the signals, and require that the coded signals be present in a stable form for a predetermined time before the liquid level data is considered valid. The validated data is the analyzed by a data analysis unit in order to determine the possible threat of flash flood and/or stage flood. If such a threat exists the central disaster alert station may be automatically activated and then transmits coded R.F. activation signals which selectively activate disaster alert modules in the threatened areas.

The novel features of the invention are set forth in the appended claims. The invention will best be understood from the following description when read in conjunction with the accompanying drawings.

DESCRIPTION OF THE PREFERRED EMBODIMENTS

Figure 1:
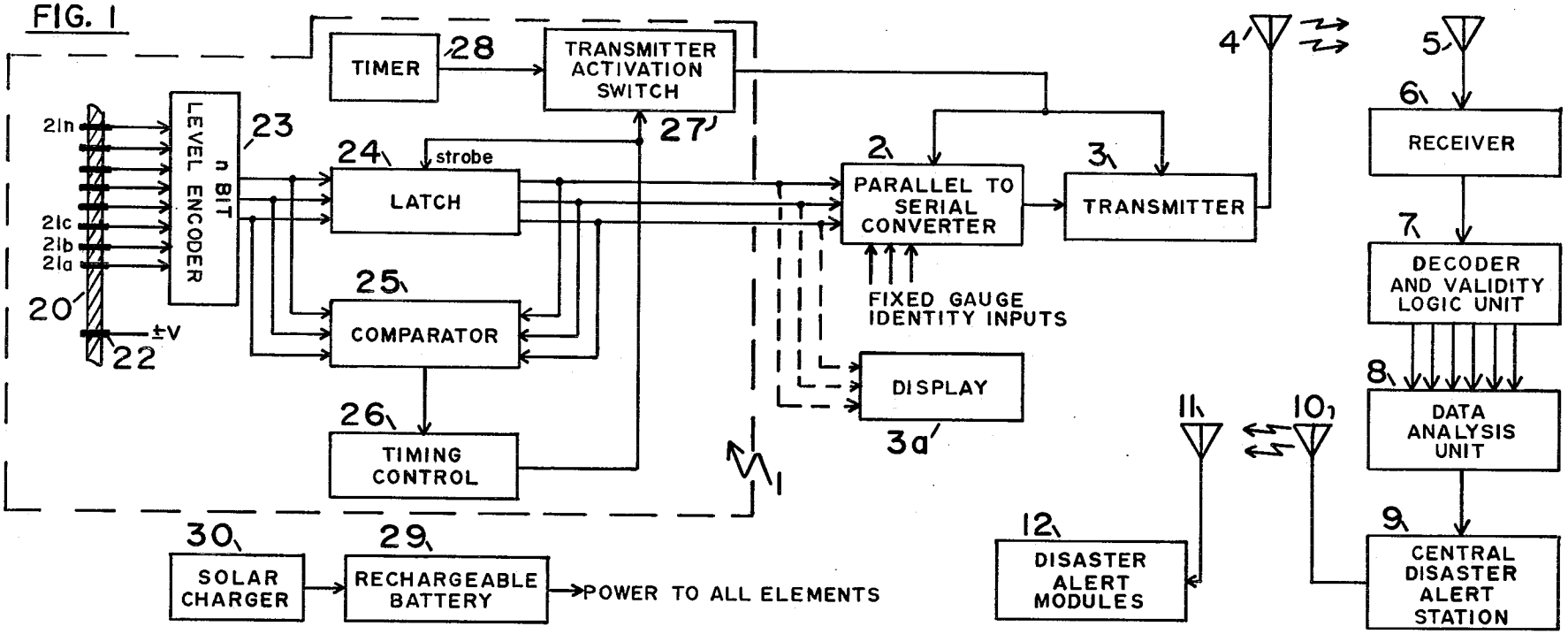
FIG. 1 is a block diagram of one embodiment of the present invention.

Referring to FIG. 1, which represents the system of the present invention diagramed in block form, including elements contained in the subject application of which this application is a continuation in part, reference numeral 1 designates a remotely located and independent digital liquid level gauge which measures the level of liquid in a desired location and provides such liquid level data to a parallel to serial converter 2 which converts the level data into a serial form to be transmitted by transmitter 3. Said transmitter transmits first coded radio frequency (R.F.) signals of short duration via antenna 4. The information content of said first coded R.F. signals specifies the current liquid level measured by said digital liquid level gauge, and may also specify the identity of a particular one of a plurality of such gauges.

Said first coded R.F. signals are received by receiver 6, via antenna 5. Said first coded R.F. signals are then decoded and validated by decoder and validity logic unit 7. Validated data is then analyzed by the data analysis unit 8. Such data analysis includes, but is not limited to, comparisons of current conditions and calculated parameters, to predetermined criteria. Variables such as accumulated liquid level, rate of change of level correlated with time, antecedant conditions, and location are analyzed for potential to produce flash flood and/or stage flood conditions. Data is also tabulated and stored for future use.

If data analysis indicates probable flash flood or stage flood conditions, data analysis unit 8 may automatically activate a central disaster alert station 9, which then transmits second coded R.F. signals hereafter called activation signals, via central disaster alert station antenna 10. Said coded activation signals specify selected disaster alert modules, a plurality of which are designated as 12, which are to be activated due to their location in threatened areas, according to the teachings of the subject invention. Said activation signals received by disaster alert modules 12 via antennas 11, being those disaster alert modules 12, which are selectively specified by said activation signals, are thus activated, produce audio and visual alarms followed by audio disaster alert messages, transmitted by said central disaster alert station according to the teachings of the subject invention of which this application is a continuation in part.

With further reference to FIG. 1, a more detailed description of the preferred embodiments of said digital liquid level gauge indicated by numeral 1 follows. Numeral 20 designates a mounting means for level sensing electrodes 21*a* through 21*n*. Said mounting means may be constructed from any rigid material of any desired shape, so long as the level sensing electrodes are maintained in a desired spatial relationship to each other and are electrically insulated from each other. The mounting means 20 also secures a means 22 for applying a voltage to any or all of said level sensing electrodes through any somewhat electrically conductive liquid which may come in contact with said voltage applying means 22 and said level sensing electrodes. Said voltage applying means may take the form of an electrode, conductive plate, or may be an integral part of the mounting means 20, and may apply a voltage of either positive or negative polarity as compatible with logic circuitry to be described. Said level sensing electrodes 21*a* through 21*n* may be spaced at any discrete intervals in the vertical dimension to achieve any desired gauge resolution. As can be appreciated by those skilled in the art, when the level of the liquid being measured rises or falls, voltage is applied to higher and lower electrodes respectively. An n-bit level encoder 23, detects the presence or absence of voltage at each level sensing electrode 21*a* through 21*n*. The digital nature of encoder 23 is insensitive to the electrical properties of the liquid such as resistance, capacitance, or inductance, or changes thereof, so long as the liquid is somewhat conductive. Said n-bit level encoder 23 generates digital outputs which discretely represent the uppermost level sensing electrode which is in contact with said liquid. Said digital outputs of level encoder 23, hereafter called the current liquid level value, are fed to the inputs of first latch 24, and to a first set of inputs to first comparator 25. The digital outputs of said first latch 24, said outputs hereafter called the latched liquid level value, are fed to a second set of inputs to said first comparator 25, said latched liquid level value being a set of digital outputs similar to those generated by n-bit level encoder 23.

As is known to those skilled in the art, said first comparator 25 can detect when said current liquid level value at said first inputs and said latched liquid level value at said second inputs to said first comparator 25 are different. Whenever such condition exists, and for the duration that such condition exists, a first pulse is supplied to timing control 26. If said first pulse persists for a minimum predetermined time, which defines the time requirement for a bonified level change, as set by timing control 26, a second pulse is generated at the output of said timing control. Said second pulse is fed to transmitter activation switch 27, and to the strobe input of said first latch 24. Whenever said second pulse is applied to the strobe input of latch 24, said current liquid level value appearing on the latch input lines is duplicated on the latch output lines, becoming the new latched liquid level value. After a very short delay, parallel to serial converter 2 and transmitter 3 are activated for a predetermined time by transmitter activation switch 27, which activates said parallel to serial converter and said transmitter each time said second pulse occurs. Parallel to serial converter 2 converts the digital outputs of said first latch 24, which are in parallel form, to a serial pulse coded sequence which uniquely defines the bonified liquid level. Said serial pulse coded sequence may also contain intelligence specifying the gauge identity, which is not variable as is the liquid level intelligence, by supplying additional gauge identity fixed inputs to parallel to serial converter 2.

Figure 2:
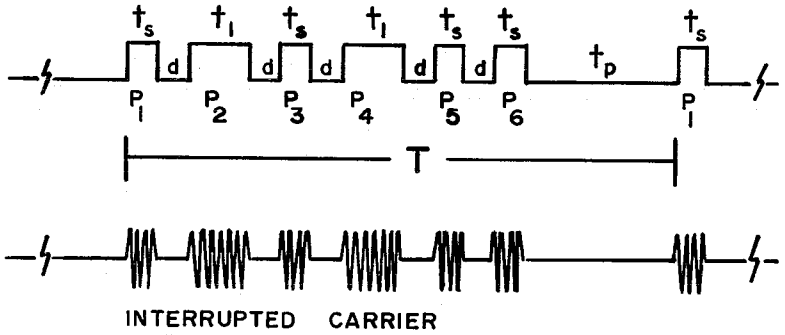
FIG. 2 is a diagram useful in understanding the operation of elements of the invention.

An example of a possible code frame of said serial pulse coded sequence is shown in FIG. 2. Each code frame lasts for time T, and contains, in this example, 6 pulses $P_1$ through $P_6$. The time duration of each pulse is either short, $t_s$, or long, $t_l$, where short pulses represent logic zeroes and long pulses represent logic ones for binary digital coding. In this example some of the pulses might specify the gauge identity, while the remaining pulses specify the latched liquid level output of said first latch. The pulses are separated by delays d, and are followed by a longer delay, or sync pause of duration $t_p$, which is variable, depending on the total duration of the pulses $P_1$ through $P_6$. The sync pause serves as a synchronizing signal for receiver decoder logic. In actual practice the number of pulses in a code frame can be any integer greater than one, and the number of pulses designated for gauge identity and level data respectively can be selected. If a plurality of digital liquid level gauges uses a coding scheme where each code frame consists of $y+z$ pulses, where y is the number of pulses which specifies the gauge identity, and z is the number of pulses which specifies the liquid level data, then $2^y$ possible distinct gauge identities and $2^z$ distinct liquid levels can be specified by the coding scheme.

Again referring to FIG. 1, said serial pulse coded sequence controls transmitter 3 such that a first coded R.F. signal is transmitted via antenna 4. Said transmitted first coded R.F. signal may be, but is not limited to an interrupted carrier representing the repeating code frames of said serial pulse coded sequence, so that as an example, the carrier is present during the periods corresponding to the pulses, and is interrupted during the delays and sync pause as is shown in FIG. 2. Such an interrupted carrier signal therefore uniquely specifies the gauge identity and the liquid level data. Further security in gauge identification can be gained by using different R.F. carrier frequencies or bandwidths for each gauge.

It is apparent to those skilled in the art that said first coded R.F. signals are transmitted only when the liquid level changes by at least one increment from the level corresponding to the previously transmitted signal, said increment determined by the vertical spacing of said level sensing electrodes. The level change must also qualify as a bonified level change. This must be the case, since at the instant of any liquid level gauge transmission the inputs to said first latch, said current liquid level value, and the outputs of said first latch, said latched liquid level value are equal, thus terminating said first pulse output of said first comparator 25. Because said first latch maintains the same output until it receives said second pulse from timing control 26, which can only occur when said first pulse occurs again and persists for a minimum time, said current liquid level value, and said latched liquid level value remain identical until the liquid level changes by at least one increment, triggering said first pulse.

Additionally, timer 28, which can be set for any desired time period such as once every 24 hours, periodically activates transmitter activation switch 27, resulting in periodic data transmission regardless of changes in the liquid level or lack thereof. The purpose of such action is to provide a means for automatic testing of gauge functions. Data analysis unit 8, when suitably programmed, checks for consistent data during these periodic automatic tests.

Under certain circumstances, it may be desirable to diplay the bonified level data as measured by said digital liquid level gauge, in addition to, or instead of transmitting the data. This may be particularly appropriate when said digital liquid level gauges are located at sites such as dams and reservoirs which are manned by personnel who monitor other local conditions. Also, said digital liquid level gauges may be used in other applications such as for measuring liquid levels in tanks, containers, pipes or other enclosures, where direct observation of the level data is desirable. In those cases, a display means 3*a* connected to the outputs of said first latch 24 is provided for displaying the bonified level as measured by said digital liquid level gauge. Said display means may utilize any type of digital visual display such as but not limited to LEDs, quartz crystal, or incandescent tube, or any type of analog display such as a meter, or any printing device.

Electrical power requirements for said digital liquid level gauge, said parallel to serial converter, and said transmitter are provided by rechargeable battery pack 29, which may be recharged during favorable conditions by solar charger 30, or at any time by conventional charging means.

Figure 3:
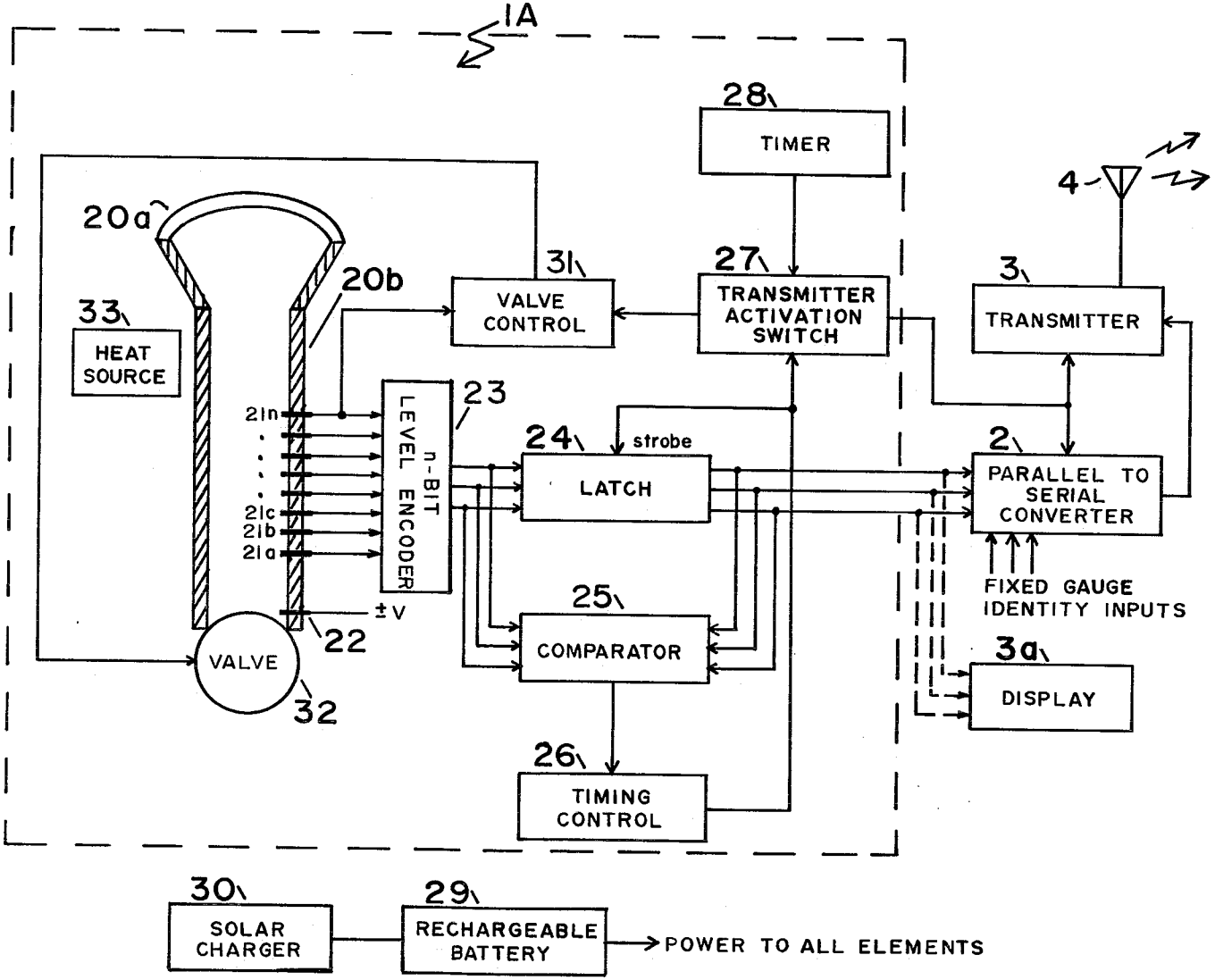
FIG. 3 is a block diagram of another embodiment of an element contained in FIG. 1.

Attention is now directed to FIG. 3, numeral 1A, which contains a block diagram of but one embodiment of a digital rain gauge which is a special adaptation of said digital liquid level gauge designated as numeral 1 of FIG. 1. The operation of the digital rain gauge is similar in most respects to the digital liquid level gauge. The special adaptations are concerned with; collecting the atmospheric precipitation whose level is to be measured, emptying accumulated atmospheric precipitation, and melting atmospheric precipitation occuring in the frozen state so that its liquid equivalent level may be measured. Numeral 20*a* of FIG. 3 designates a collecting vessel which is open to the atmosphere and collects atmospheric precipitation. It is essentially funnel shaped so that collected precipitation is conducted to level sensing column 20*b*, which is contiguous with collecting vessel 20*a*. Collecting vessel 20*a* and level sensing column 20*b* may be fabricated as a single unit or as two separate units. Level sensing column 20*b* is a specially adapted form of the mounting means 20 in FIG. 1. Said level sensing column may be constructed from any rigid materials which maintain level sensing electrodes 21*a* through 21*n* in a desired spaced relationship, and provide electrical insulation between the level sensing electrodes. Said level sensing column must also secure voltage applying means 22. The lower end of level sensing column 20*b* is normally closed by emptying valve 32. As precipitation is collected in collecting vessel 20*a* and accumulated in level sensing column 20*b*, said precipitation provides somewhat conductive paths between voltage applying means 22 and level sensing electrodes 21*a* through 21*n*.

Those skilled in the art will recognize that the resolution of the gauge may be altered according to demands by changing the relative cross sectional areas of said collecting vessel and said level sensing column, and by changing the spacing of said level sensing electrodes. Furthermore by appropriate combination of level sensing column shape, and level sensing electrode spacing, various degrees of linearity can be achieved.

N-bit level encoder 23, first latch 24, first comparator 25, timing control 26, transmitter activation switch 27, parallel to serial converter 2, transmitter 3, and display means 3*a* co-operate in the manner described for the more general digital liquid level gauge. Emptying valve control 31 receives inputs from the uppermost level sensing electrode 21*n*, and from transmitter activation switch 27. When the level of accumulated precipitation in said level sensing column 20*b* reaches electrode 21*n*, and after transmitter activation is complete as controlled by said transmitter activation switch 27, emptying valve control 31 operates emptying valve 32, for a selectable time, very rapidly draining the accumulated precipitation from level sensing column 20*b*. Those skilled in the art recognize that the level sensing column is very rapidly emptied whenever the level sensing column is filled to its measuring capacity, and after data transmission is complete. Suitable programming of data analysis unit 8, of FIG. 1, will result in proper interpretation of data collected subsequent to emptying of the level sensing column.

Timer 28 periodically activates transmitter activation switch 27, as previously described, and also activates emptying valve control 31. This process provides the automatic gauge function check as described previously, as well as automatically checking the emptying mechanisms and resetting the digital rain gauge for a new data collection period.

Heat source 33 in close proximity to collecting vessel 20*a* and level sensing column 20*b* provides heat for converting precipitation occurring in the frozen state to a liquid state, and for maintaining the accumulated precipitation in a liquid state, the level of which is readily measured by said digital rain gauge.

Said digital liquid level gauge may be adapted for use as a digital stream level gauge, by arranging that said mounting means 20, level sensing electrodes 21*a* through 21*n*, and voltage applying means 22 are placed generally perpindicular to and exposed to the rising and falling level of water in the stream, or other water conveying channel. FIG. 1 and the previous description of said digital liquid level gauge serve to explain the elements and function of the digital stream level gauge.

The described digital liquid level gauge, and specially adapted versions thereof, transmit data only when a bonified level change occurs (except for periodic self-checking transmissions), therefore drastically reducing the energy requirements of such an automated gauge, compared to any type of gauge which transmits at regular and frequent intervals regardless of data changes. Furthermore, the logic circuitry described can be made to operate on extremely low power for indefinite periods by utilizing state-of-the-art integrated circuit technologies. Higher power requirements exist only for the very short periods when data transmissions occur. The short transmission periods also greatly reduce the amount of electromagnetic radiation introduced into the environment, thus decreasing the contribution of this system to the electromagnetic interference (EMI) problem.

Attention is now directed to those elements of the present invention concerned with receiving, decoding, validating, and analyzing the transmitted liquid level data. Said first coded R.F. signals are received by receiver 6 of FIG. 1, which is tuned to receive signals of the appropriate R.F. carrier frequency, and detects the presence or absence of the R.F. interrupted carrier. Said receiver produces a serial pulse coded signal in which the pulses occur whenever and for the duration that said receiver detects said R.F. carrier, thereby duplicating said serial pulse coded sequence generated by parallel to serial converter 2 of FIG. 1. Said serial pulse coded signal is fed to decoder and validity logic unit 7 which extracts gauge identity and liquid level data from said serial pulse coded signal.

Figure 4:
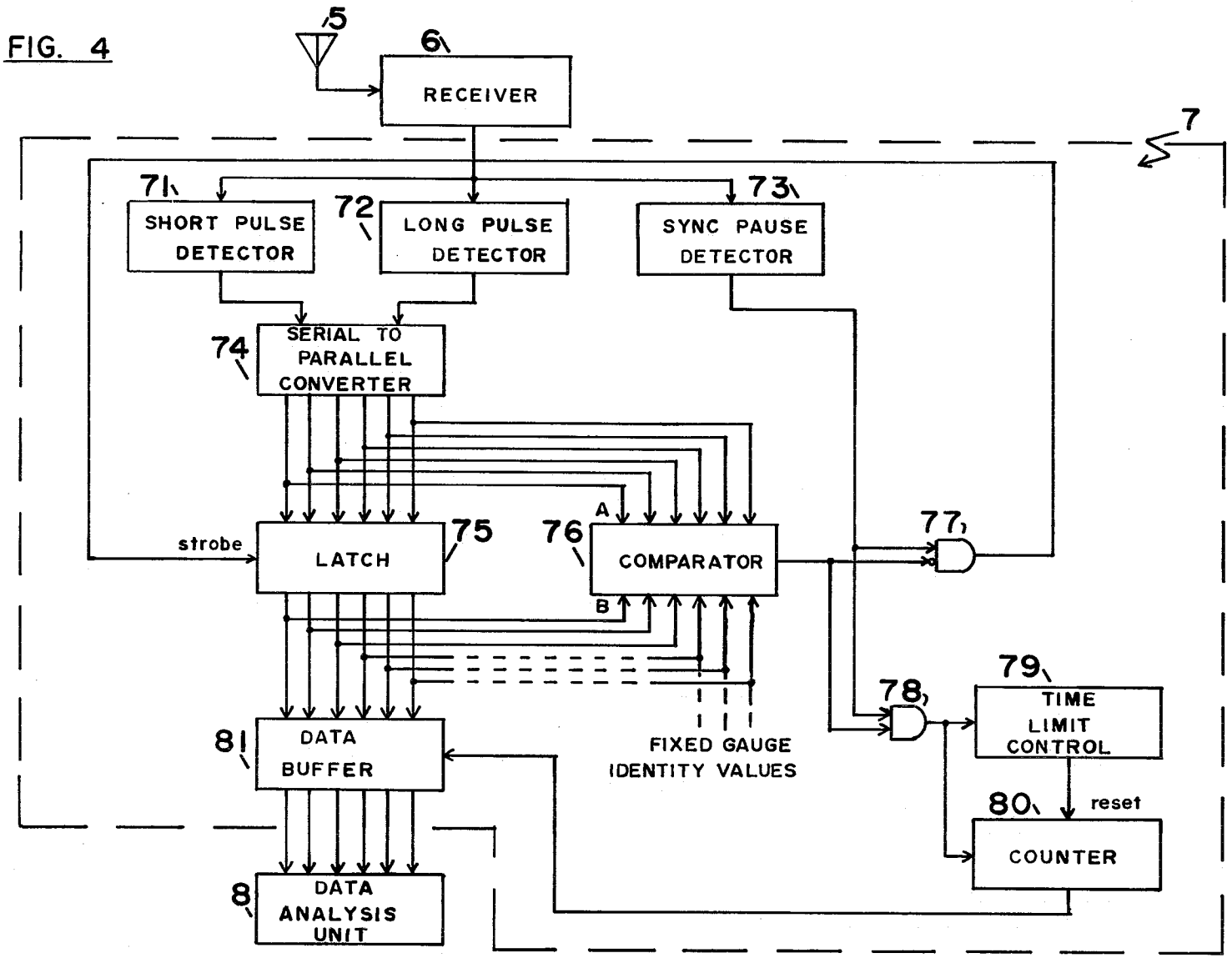
FIG. 4 is a block diagram of one embodiment of an element contained in FIG. 1.

Refer now to FIG. 4 which contains a block diagram of but one embodiment of the decoder and validity logic unit 7 of FIG. 1. The output of receiver 6, said serial pulse coded signal, is simultaneously fed to short pulse detector 71, long pulse detector 72, and sync pause detector 73, all of which are essentially timing circuits which detect pulses and/or delays of the appropriate durations existing in said serial pulse coded signal. The short pulse detector 71 produces a third pulse output whenever said serial pulse coded signal contains a pulse of a preselected minimum duration, for example somewhat less than $t_s$ of FIG. 2. Said long pulse detector 72 produces a fourth pulse output whenever said serial pulse coded signal contains a pulse of a preselected and longer duration, for example longer than $t_l$ of FIG. 2. Sync pause detector 73 produces a fifth pulse output whenever the time following a pulse in said serial pulse coded signal exceeds the normal delay d between pulses, and thus indicates the end of a pulse train in a given code frame of said serial pulse coded signal. This serves to synchronize the coding and decoding of the transmitted and received signals respectively. Said third and fourth pulses are applied to the inputs of serial to parallel converter 74. As an illustrative example, serial to parallel converter may take the form of a shift register which is advanced one stage each time a clock pulse is applied, and accepts digital data on a data input line. If said third pulse acts as a clock pulse, and said fourth pulse, when it occurs, represents a binary one on the data input line, then such a shift register would convert the serial pulse coded signal to a parallel digital output. At the end of a code frame, i.e., when a sync pause is detected, the parallel digital output of said serial to parallel converter uniquely represents one frame of the serial pulse coded signal, where a binary one on the output of said serial to parallel converter corresponds to a long pulse occurring in said serial pulse coded signal, and a binary zero corresponds to a short pulse.

Elements 71 through 74 accomplish the basic decoding function, however it is desirable to insure security and validity of the data by requiring some number, x, of identical repetitions of the data before it is considered valid data. The outputs of serial to parallel converter 74 are supplied to second latch 75 and to the A inputs of second comparator 76. The outputs of said second latch 75 are fed to a data buffer 81 and to the B inputs of said second comparator 76. Said second comparator 76 produces a sixth pulse output whenever and for the duration that the output of said serial to parallel converter, and the output of said second latch are equal. The output of said second comparator 76 is connected to the inverting input of a first logic gate 77. The output of sync pause detector 73 is connected to the non-inverting input of said first logic gate 77. Logic gate 77 produces a seventh pulse output if and only if a sync pause is detected (indicated by said fifth pulse) and said second comparator 76 indicates, by the absence of said sixth pulse, that the output of said serial to parallel converter and said second latch are not equal. Said seventh pulse is applied to the strobe input of said second latch 75 and causes the digital input to the latch to be duplicated at the latch output. This results in the A and B inputs to said second comparator 76 becoming digitally and logically equal and consequently terminating said seventh pulse. The purpose of this operation is to latch the value of any new data which is received so that it can be validated as will be described.

The output of said second comparator 76 is also applied to one input of second logic gate 78, and the output of said sync pause detector 73 is applied to the other input of logic gate 78. Logic gate 78 produces an eigth pulse whenever said fifth pulse and said sixth pulse occur simultaneously. Said eigth pulse signifies the condition that the output of said serial to parallel converter 74, and the output of said second latch 75 are equal at the time of a sync pause. In other words if newly received data code frames are identical to previously received code frames, said eigth pulse occurs.

The output of said second logic gate 78 is connected to time limit control 79 and to counter 80, which is normally advanced one count each time said eigth pulse occurs. Time limit control 79 produces a ninth pulse, which is applied to the reset input of said counter 80, if said eigth pulse does not occur after the preceding eigth pulse within a period slightly longer than the code frame period, T. Thus the counter is advanced one stage each time said eigth pulse occurs, but is reset whenever said ninth pulse occurs. Therefore, said counter 80 counts to number of times which identical code frames are decoded consecutively without error and without change. Said counter produces a tenth pulse when its count exceeds some preselected value, x. Said tenth pulse when applied to data buffer 81, causes said data buffer to accept the data output of said second latch 75. Data contained in data buffer 81 is then considered to be valid data, having been received and decoded x consecutive times without error or change.

Those skilled in the art will realize that if even a single code frame is received and decoded, and is different than immediately preceding received and decoded code frames, before the $x^{th}$ identical code frame is counted by counter 80, the counter will be reset and the process must start again. By appropriate choice of the value of x, high reliability and validity of the data is assured.

By arranging that fixed digital values (zeroes or ones) are applied to one or more of the B inputs to said second comparator 76, rather than those inputs being connected to the output of said second latch 75, the data buffer can only be loaded with validated data which has those fixed digital values in the appropriate sequential positions in the code frame. Such a scheme is useful in restricting data collection to that originating from a particular liquid level gauge. By fixing those B inputs to said second comparator which correspond to gauge identifying bits in the code frame, only data which meets the x identical repetitions requirement and which contains the identical gauge identifying portion of the code frame will be considered valid.

It should be emphasized that the entire code generating, transmitting, receiving, decoding and validating process occurs very rapidly. As an illustrative example, if the code fame repetition rate is 100/second, and the code validating requirement, x, is equal to 16, the validated data is available in about 160 milliseconds. Of course much higher repetition rates are possible with consequent reduction in data validation time.

Another benefit of the coding, receiving, decoding and validating scheme recited in this disclosure, is that multiple gauges or other code transmitting devices may use the same R.F. frequency or bandwidth, so long as their transmissions are relatively infrequent, and of short duration. This is so because the probability of total overlap of transmission times is very low. When partial overlap occurs the decoding and validating circuits will not accept data since it would not be constant due to mutual interference of the signals. However, since only brief periods of non-overlapping conditions are required to accurately decode and validate the data, statistically, a very high proportion of transmitted data would be received, decoded, and validated even in the event that partial overlap did occur. This coding, decoding and validating scheme will therefore find wide application in other data communications systems.

As described earlier, individual liquid level gauge transmitters may transmit said first coded R.F. signals on different R.F. carrier frequencies or bandwidths. In that case separate and multiple receivers are used for each frequency or bandwidth, providing additional selectivity and security for the identification of data origin, and eliminating any possible mutual interference.

Validated data is provided to data analysis unit 8 of FIG. 1, which time tags the data with the actual time of signal reception. The data is then processed and stored by conventional means so that accumulated liquid levels, level rise or fall rates, and antecedent conditions are available for analysis and evaluation in a flood basin model. Such a model would take into consideration the geography of the area being monitored, the anticedent weather conditions, critical rainfall and stream level values, and critical rates of change in addition to the data derived from the remotely located gauges. All data is then evaluated for potential to produce flash flood or stage flood conditions. Conventional peripheral devices make data available for inspection and modification by personnel. As previously described, data analysis unit 8 may automatically activate central disaster alert station 9 of FIG. 1, in the event of imminent flood conditions. Said central disaster alert station would then transmit said second coded R.F. signals (activation signals) which activate those disaster alert modules 12 which are appropriate for the threatened area(s), according to the teachings of the subject invention, of which this application is a continuation in part. Similar coding, decoding and validating schemes to those already described are used in the central disaster alert station, and the disaster alert modules.

It is to be understood that the foregoing description relates to a specific embodiment of the invention illustrating the various features thereof, and inasmuch as the various modifications may be made to the circuits and other apparatus described above without departing from the spirit and scope of the invention, this description is not to be construed in a limiting sense.

An example of a modification which would not depart from the spirit and scope of the invention is the use of frequency modulation of the carrier of said first coded R.F. signal, rather than using an interrupted carrier. In that case the frequency of the carrier is modulated by the serial pulse coded sequence input to the transmitter. The receiver would then similarly receive and demodulate said first coded R.F. signal. Additionally, logic elements such as latches, comparators, and data buffers may be replaced by any logic circuit combinations which achieve essentially equivalent functions. Consequently it is intended that the appended claims be interpreted to cover such modifications and equivalents.

What is claimed is:

1. An early flood warning system comprising:

a digital liquid level gauge for measuring the level of liquid in discrete increments at desired locations;

a plurality of level sensing electrodes in said digital liquid level gauge for providing possible electric current paths in conjunction with the current carrying capability of somewhat electrically conductive liquid in contact with said level sensing electrodes;

a means for mounting said level sensing electrodes in a spaced relationship to each other, and in a desired relationship to the liquid whose level is being measured;

a means for applying a voltage to said level sensing electrodes via liquid in contact with said level sensing electrodes and said voltage applying means;

an n-bit level encoder connected to said level sensing electrodes for detecting which of said level sensing electrodes are in contact with said liquid whose level is being measured, and for generating a digital output which uniquely defines the uppermost of said level sensing electrodes in contact with said liquid;

a first latch connected to said level encoder for storing the digital output of said level encoder, and for providing a digital output of the stored value;

a first comparator connected to said level encoder and to said first latch for comparing the digital output of said level encoder and the digital output of said first latch, and for generating a first pulse whenever and for the duration that the digital output of said level encoder and the digital output of said first latch are unequal;

a timing control whose input is connected to said first comparator output and whose output is connected to said first latch, for detecting if said first pulse persists for a selectable minimum time, and for providing a second pulse to said first latch whenever said first pulse does persist for said selectable minimum time, said second pulse when applied to said first latch causes said first latch to store the digital output of said level encoder;

a parallel to serial converter connected to said first latch output for converting the parallel output of said first latch to a serial pulse coded sequence of repeating code frames, each code frame consisting of a train of pulses and each code frame uniquely defining the parallel output of said first latch;

a transmitter connected to said parallel to serial converter for transmitting a first coded R.F. signal by R.F. carrier, representing said serial pulse coded sequence;

a transmitter activation switch connected to the output of said timing control, to said parallel to serial converter, and to said transmitter for activating said parallel to serial converter and said transmitter for a selectable time whenever said second pulse occurs;

a receiver for receiving said first coded R.F. signals and for producing a serial pulse coded signal which represents said first coded R.F. signal;

a short pulse detector connected to said receiver for producing a third pulse whenever said serial pulse coded signal contains a pulse of a selectable minimum duration;

a long pulse detector connected to said receiver for producing a fourth pulse whenever said serial pulse coded signal contains a pulse of a selectable duration longer than that detected by said short pulse detector;

a sync pause detector connected to said receiver for producing a fifth pulse whenever the time following a pulse in said serial pulse coded signal exceeds a selectable maximum time;

a serial to parallel converter connected to said short pulse detector and to said long pulse detector for converting the output of said short pulse detector and the output of said long pulse detector, said third and fourth pulses respectively, to a parallel digital output which uniquely represents said serial pulse coded signal;

a second latch connected to said serial to parallel converter for storing the output of said serial to parallel converter, and for providing a digital output of the stored value;

a second comparator connected to said serial to parallel converter and to said second latch, for comparing the digital output of said serial to parallel converter and the digital output of said second latch, and for producing a sixth pulse whenever said digital output of said serial to parallel converter and the digital output of said second latch are equal;

a first logic gate connected to said sync pause detector, to said second comparator, and to said second latch for determining when said fifth pulse occurs in the absence of said sixth pulse, and for then producing a seventh pulse, which triggers said second latch to store the digital output of said serial to parallel converter;

a second logic gate connected to said sync pause detector, and to said second comparator, for producing an eighth pule when said fifth pulse and said sixth pulse occur simultaneously;

a counter connected to said second logic gate for counting the number of said sixth pulses, and for producing a tenth pulse when said counter reaches a selectable minimum count;

a time limit control connected to said second logic gate and to said counter for producing a ninth pulse if a minimum selectable time elapses between the occurences of said eigth pulses, said ninth pulse resetting said counter; and a data buffer connected to said second latch and to said counter for storing the digital output of said second latch when said tenth pulse occurs, and for providing a digital output of the stored value.

2. The arrangement as recited in claim 1 further comprising a timer, connected to said transmitter activation switch, for periodically energizing said transmitter activation switch.

3. The arrangement as recited in claim 1 wherein said parallel to serial converter has gauge identity fixed inputs applied, and thereby converts the parallel output of said first latch and the gauge identity fixed inputs to a serial pulse coded sequence of repeating code frames, each code frame consisting of a train of pulses and each code frame uniquely defining the parallel output of said first latch in combination with the gauge identity fixed inputs.

4. The arrangement as recited in claim 1 wherein said digital liquid level gauge is specially adapted for measuring the water in a water conveying channel, and wherein said means for mounting said level sensing electrodes is rigid and is located in a desired spatial relationship to the water in the water conveying channel.

5. The arrangement as recited in claim 4 further comprising a timer connected to said transmitter activation switch for periodically energizing said transmitter activation switch.

6. The arrangement as recited in claim 1 wherein said digital liquid level gauge is specially adapted for measuring atmospheric precipitation, and further comprises:

a collecting vessel for collecting atmospheric precipitation;

a level sensing column contigous with said collecting vessel and partially composed of said means for mounting said level sensing electrodes, for accumulating atmospheric precipitation collected by said collecting vessel;

an emptying valve appended to the lower end of said level sensing column for rapidly draining the atmospheric precipitation therefrom; and an emptying valve control connected to said emptying valve, and to the uppermost of said level sensing electrodes, for operating said emptying valve whenever atmospheric precipitation fills said level sensing column to its measuring capacity.

7. The arrangement as recited in claim 6 further comprising a timer connected to said transmitter activation switch and to said emptying valve control for periodically energizing said transmitter activation switch and said emptying valve control.

8. The arrangement as recited in claim 6 further comprising a heat source in close proximity to said collecting vessel and said level sensing column for providing necessary heat to convert collected atmospheric precipitation in the frozen state to a liquid state, and to maintain collected and accumulated atmospheric precipitation in the liquid state.

9. A digital liquid level gauge comprising:

a plurality of level sensing electrodes for providing possible current carrying paths in conjunction with the current carrying capability of somewhat electrically conductive liquid in contact with said level sensing electrodes;

a means for mounting said level sensing electrodes in a spaced relationship to each other, and in a desired relationship to the liquid whose level is being measured;

a means for applying a voltage to said level sensing electrodes via liquid in contact with said level sensing electrodes and said voltage applying means;

an n-bit level encoder connected to said level sensing electrodes for detecting which of said level sensing electrodes are in contact with said liquid whose level is being measured, and for generating a digital output which uniquely defines the uppermost of said level sensing electrodes in contact with said liquid;

a first latch connected to said level encoder for storing the digital output of said level encoder, and for providing a digital output of the stored value;

a first comparator connected to said level encoder and to said first latch for comparing the digital output of said level encoder and the digital output of said first latch, and for generating a first pulse whenever and for the duration that the digital output of said level encoder and the digital output of said first latch are unequal; and a timing control whose input is connected to said first comparator output and whose output is connected to said first latch, for detecting if said first pulse persists for a selectable minimum time, and for providing a second pulse to said first latch whenever said first pulse does persist for said selectable minimum time, said second pulse when applied to said first latch causes said first latch to store the digital output of said level encoder.

10. The arrangement as recited in claim 9 further comprising a display means connected to said first latch, for displaying the measured liquid level as represented by the digital output of said first latch.

11. The arrangement as recited in claim 9 further comprising:

a transmitter connected to said latch for transmitting first coded R.F. signals representing the digital output of said first latch whenever said transmitter is activated; and a transmitter activation switch connected to said timing control and to said transmitter, for activating said transmitter for a selectable time whenever said first pulse occurs.

12. The arrangement as recited in claim 11 further comprising a timer connected to said transmitter activation switch, for periodically energizing said transmitter activation switch.

13. The arrangement as recited in claim 9 wherein said digital liquid level gauge is specially adapted for measuring the water in a water conveying channel, and wherein said means for mounting said level sensing electrodes is rigid and is located in a desired spatial relationship to the water in the water conveying channel.

14. The arrangement as recited in claim 13 further comprising a display means connected to said first latch, for displaying the measured liquid level as represented by the digital output of said first latch.

15. The arrangement as recited in claim 13 further comprising:

a transmitter connected to said latch for transmitting first coded R.F. signals representing the digital output of said first latch whenever said transmitter is activated; and a transmitter activation switch connected to said timing control and to said transmitter, for activating said transmitter for a selectable time whenever said first pulse occurs.

16. The arrangement as recited in claim 15 further comprising a timer connected to said transmitter activation switch, for periodically energizing said transmitter activation switch.

17. The arrangement as recited in claim 9 wherein said digital liquid level gauge is specially adapted for measuring atmospheric precipitation, and further comprises:

a collecting vessel for collecting atmospheric precipitation;

a level sensing column contiguous with said collecting vessel and partially composed of said means for mounting said level sensing electrodes, for accumulating atmospheric precipitation collected by said collecting vessel;

an emptying valve appended to the lower end of said level sensing column for rapidly draining the atmospheric precipitation therefrom; and an emptying valve control connected to said emptying valve, and to the uppermost of said level sensing electrodes, for operating said emptying valve whenever atmospheric precipitation fills said level sensing column to its measuring capacity.

18. The arrangement as recited in claim 17 further comprising a heat source in close proximity to said collecting vessel and said level sensing column for providing necessary heat to convert collected atmospheric precipitation in the frozen state to a liquid state, and to maintain collected and accumulated atmospheric precipitation in the liquid state.

19. The arrangement as recited in claim 17 further comprising a display means connected to said first latch, for displaying the measured liquid level as represented by the digital output of said first latch.

20. The arrangement as recited in claim 17 further comprising:

a transmitter connected to said latch for transmitting first coded R.F. signals representing the digital output of said first latch whenever said transmitter is activated; and a transmitter activation switch connected to said timing control and to said transmitter, for activating said transmitter for a selectable time whenever said first pulse occurs.

21. The arrangement as recited in claim 20 further comprising a timer connected to said transmitter activation switch, for periodically energizing said transmitter activation switch.

22. A decoder and validity logic unit for decoding and validating a serial pulse coded signal, comprising:

a short pulse detector to which said serial pulse coded signal is applied, for producing a third pulse whenever said serial pulse coded signal contains a pulse of a selectable minimum duration;

a long pulse detector to which said serial pulse coded signal is applied, for producing a fourth pulse whenever said serial pulse coded signal contains a pulse of a selectable duration longer than that detected by said short pulse detector;

a sync pause detector to which said serial pulse coded signal is applied, for producing a fifth pulse whenever the time following a pulse in said serial pulse coded signal exceeds a selectable maximum time;

a serial to parallel converter connected to said short pulse detector and to said long pulse detector, for converting the output of said short pulse detector and the output of said long pulse detector, said third and fourth pulses respectively, to a parallel digital output which uniquely represents said serial pulse coded signal;

a second latch connected to said serial to parallel converter for storing the output of said serial to parallel converter, and for providing a digital output of the stored value;

a second comparator connected to said serial to parallel converter and to said second latch, for comparing the digital output of said serial to parallel converter and the digital output of said second latch, and for producing a sixth pulse whenever said digital output of said serial to parallel converter and the digital output of said second latch are equal;

a first logic gate connected to said sync pause detector, to said second comparator, and to said second latch for determining when said fifth pulse occurs in the absence of said sixth pulse, and for then producing a seventh pulse, which triggers said second latch to store the digital output of said serial to parallel converter;

a second logic gate connected to said sync pause detector, and to said second comparator, for producing an eigth pulse when said fifth pulse and said sixth pulse occur simultaneously;

a counter connected to said second logic gate for counting the number of said sixth pulses, and for producing a tenth pulse when said counter reaches a selectable minimum count;

a time limit control connected to said second logic gate and to said counter for producing a ninth pulse if a minimum selectable time elapses between the occurences of said eigth pulses, said ninth pulse resetting said counter.

23. The arrangement recited in claim 22 further comprising a data buffer connected to said second latch and to said counter for storing the digital output of said second latch when said tenth pulse occurs, and for providing a digital output of the stored value.

24. A decoder and validity logic unit for decoding and validating a serial pulse coded signal, comprising:

a short pulse detector to which said serial pulse coded signal is applied, for producing a third pulse whenever said serial pulse coded signal contains a pulse of a selectable minimum duration;

a long pulse detector to which said serial pulse coded signal is applied, for producing a fourth pulse whenever said serial pulse coded signal contains a pulse of a selectable duration longer than that detected by said short pulse detector;

a sync pause detector to which said serial pulse coded signal is applied, for producing a fifth pulse whenever the time following a pulse in said serial pulse coded signal exceeds a selectable maximum time;

a serial to parallel converter connected to said short pulse detector and to said long pulse detector, for converting the output of said short pulse detector and the output of said long pulse detector, said third and fourth pulses respectively, to a parallel digital output which uniquely represents said serial pulse coded signal;

a second latch connected to said serial to parallel converter for storing the output of said serial to parallel converter, and for providing a digital output of the stored value;

a second comparator connected to said serial to parallel converter, to said second latch, and to which fixed digital values are applied, for producing a sixth pulse whenever the digital output of said serial to parallel converter is equal to the combination of said digital output of said second latch and the applied fixed digital values;

a first logic gate connected to said sync pause detector, to said second comparator, and to said second latch for determining when said fifth pulse occurs in the absence of said sixth pulse, and for then producing a seventh pulse, which triggers said second latch to store the digital output of said serial to parallel converter;

a second logic gate connected to said sync pause detector, and to said second comparator, for producing an eigth pulse when said fifth pulse and said sixth pulse occur simultaneously;

a counter connected to said second logic gate for counting the number of said sixth pulses, and for producting a tenth pulse when said counter reaches a selectable minimum count;

a time limit control connected to said second logic gate and to said counter for producing a ninth pulse if a minimum selectable time elapses between the occurences of said eigth pulses, said ninth pulse resetting said counter.

* * * * *